US005823444A

United States Patent [19]

Reiter et al.

[11] Patent Number: 5,823,444

[45] Date of Patent: Oct. 20, 1998

[54] FUEL INJECTION VALVE

[75] Inventors: Ferdinand Reiter; Christian Preussner, both of Markgroeningen, Germany

[73] Assignee: Robert Bosch GmbH, Stuttgart, Germany

[21] Appl. No.: 670,223

[22] Filed: Jun. 20, 1996

[30] Foreign Application Priority Data

Jun. 20, 1995 [DE] Germany ..... 195 22 284.9

[51] Int. Cl.[6] ..... F02M 61/18

[52] U.S. Cl. ..... 239/533.12; 239/585.1; 239/596

[58] Field of Search ..... 239/533.1, 533.2, 239/533.3, 533.4, 533.8, 533.9, 533.12, 533.14, 533.15, 583, 584, 585.1, 585.3, 585.4, 596, 900, DIG. 19

[56] References Cited

U.S. PATENT DOCUMENTS

| | | | |
|---|---|---|---|
| 4,040,396 | 8/1977 | Tomita | 239/533.12 |
| 4,390,130 | 6/1983 | Linssen et al. | 239/585.3 |
| 4,907,748 | 3/1990 | Gardner et al. | 239/584 |
| 5,193,747 | 3/1993 | Pruesner | 239/533.12 |
| 5,207,383 | 5/1993 | Hans et al. | 239/533.12 |
| 5,437,413 | 8/1995 | Shen et al. | 239/585.4 |
| 5,484,108 | 1/1996 | Nally | 239/585.4 |
| 5,492,277 | 2/1996 | Tani et al. | 239/596 |
| 5,553,790 | 9/1996 | Findler et al. | 239/585.1 |
| 5,564,392 | 10/1996 | Oguma | 239/533.12 |
| 5,570,841 | 11/1996 | Pace et al. | 239/585.1 |

FOREIGN PATENT DOCUMENTS

| | | |
|---|---|---|
| 3927390 | 2/1991 | Germany . |
| 4026721 | 2/1992 | Germany . |

*Primary Examiner*—J. Casimer Jacyna
*Attorney, Agent, or Firm*—Edwin E. Greigg; Ronald E. Greigg

[57] ABSTRACT

A fuel injection valve for internal combustion engines with an injection port disk disposed in a longitudinal opening of a valve housing, which prevents deposits from forming due to evaporation of the fuel remaining at the injection ports after the engine is switched off. A gap disk is therefore disposed downstream of the injection port disk in the longitudinal opening of the valve housing with a slight axial spacing; the gap disk defines a recess in the axial direction which exerts a capillary action outward in the radial direction upon the fuel emerging at the injection ports. By disposing a capillary disk between the injection port disk and the gap disk, the capillary action can be optimized by means of corresponding contours in the capillary disk. The fuel injection valve is particularly suited for fuel injection in mixture-compressing engines with externally supplied ignition.

10 Claims, 1 Drawing Sheet

FUEL INJECTION VALVE

BACKGROUND OF THE INVENTION

The invention is based upon a fuel injection valve for a fuel injection engine. German patent application DE 40 26 721 Al (U.S. Pat. No. 5,263,648) discloses a fuel injection valve in which after the closing of the fuel injection valve, a slight fuel residue remains in a so-called clearance volume between the valve closing body, valve seat face, and injection port disk from which residue as a rule, only the components which boil at low temperatures evaporate, while the components of the fuel which only boil at higher temperatures remain behind and consequently, during the operation time of the fuel injection valve, after a series of operating and stop phases of the internal combustion engine, disadvantageously lead to deposits in the region of the at least one injection port, by means of which the injected quantity of fuel decreases in an undesirable manner, making the fuel/air mixture supplied to the engine too lean. As a result, the performance of the engine suffers. In view of this, German patent application DE 39 27 390 Al has already disclosed another fuel injection valve, in which a protective cap is disposed on the injection end of the fuel injection valve and at least one recess is provided on the protective cap in the immediate vicinity of the at least one injection port, which exerts a capillary action on the fuel emerging from the at least one injection port so that after the closing of the fuel injection valve, fuel possibly present at the at least one injection port is drawn into the at least one recess and deposits, which remain as a result of evaporation only remain behind in the at least one recess.

OBJECT AND SUMMARY OF THE INVENTION

The fuel injection valve according to the invention has the advantage over the prior art that even when the injection port disk is disposed in the longitudinal opening of the valve housing, a formation of deposits in the at least one injection port and thus an unintended leaning of the fuel/air mixture is prevented.

Advantageous improvements and updates of the fuel injection valve disclosed are possible as a result of the measures carried out hereinafter.

Between the injection port disk and the gap disk, it is particularly advantageous to provide a capillary disk in which the at least one recess is embodied, by means of which the contour of the recess can be produced in a simple manner and the volume of the recess can be limited to the required size.

The invention will be better understood and further objects and advantages thereof will become more apparent from the ensuing detailed description of a preferred embodiment taken in conjunction with the drawings.

DESCRIPTION OF THE PREFERRED EMBODIMENT

Figure 1:
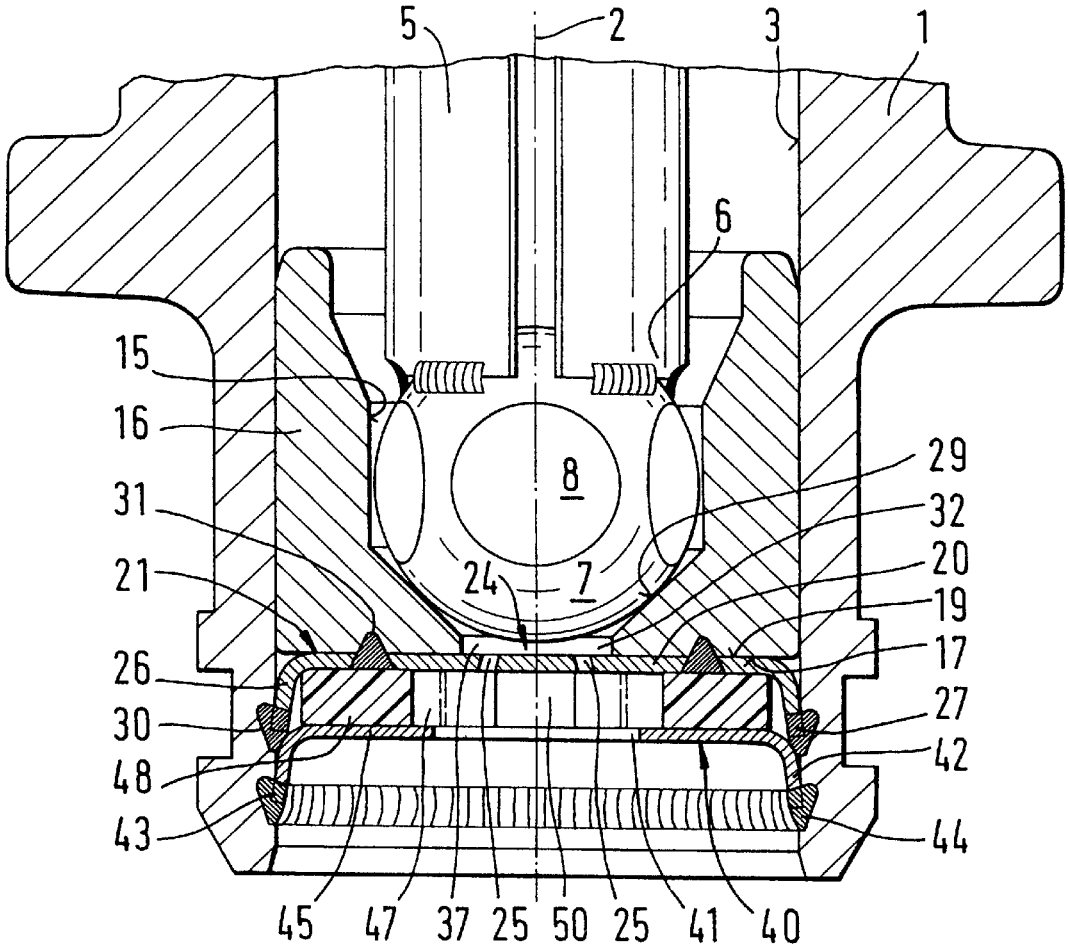
FIG. 1 shows an exemplary embodiment of the invention in conjunction with a fuel injection valve, which is schematically shown in a partial cross sectional view.

FIG. 1 shows part of one example of an otherwise already known fuel injection valve for fuel injection systems of mixture-compressing engines with externally supplied ignition, which is embodied according to the invention as a first exemplary embodiment. The fuel injection valve has a tubular valve housing 1 in which a longitudinal opening 3 is embodied concentric to a longitudinal valve axis 2. A tubular valve needle 5 is disposed in the longitudinal opening 3; on its downstream end 6, this needle is connected to a ball-shaped valve closing body 7 on whose circumference, for example five circular flat surfaces 8 are provided.

The actuation of the fuel injection valve is carried out in a known manner, for example electromagnetically. An electromagnetic circuit with a magnet coil, not shown, an armature, and a core, is used for axially moving the valve needle 5 and thus for opening the fuel injection valve counter to the spring force of a restoring spring, not shown, or for closing it. The armature, not shown, is connected to the end of the valve needle 5 remote from the valve closing body 7, and aligned with the core.

A guide opening 15 of a valve seat body 16 is used to guide the valve closing body 7 during axial motion. The cylindrical valve seat body 16 is slid into the longitudinal opening 3 on the injection end of the valve housing 1, which opening extends concentric to the longitudinal valve axis 2. The circumference of the valve seat body 16 has a slightly smaller diameter than the longitudinal opening 3 of the valve housing 1. A bottom part 20 of an injection port disk 21, which is embodied for example as cup-shaped, rests with an upper end face 19 against a lower end face 17 of the valve seat body 16, remote from the valve closing body 7, and is concentrically and securely connected to this. In its central region 24, the bottom part 20 of the injection port disk 21 has at least one injection port 25, for example four injection ports 25 formed by erosion or punching.

The bottom part 20 of the cup-shaped injection port disk 21 is adjoined by a circumferential retaining collar 26, which extends in the axial direction remote from the valve seat body 16 and is bowed conically outward until its end 27. Since the circumference diameter of the valve seat body 16 is smaller than the diameter of the longitudinal opening 3 of the valve housing 1, there is a radial compression only between the longitudinal opening 3 and the retaining collar 26 of the injection port disk 21, which collar is slightly bowed conically outward.

The insertion depth of the valve seat part into the longitudinal opening 3, which valve seat part is comprised of the valve seat body 16 and cup-shaped injection port disk 21, determines the axial stroke of the valve needle 5 since the one end position of the valve needle 5, when the magnet coil is not excited, is determined by the contact of the valve closing body 7 against a valve seat face 29 of the valve seat body 16. The other end position of the valve needle 5, when the magnet coil is excited, is determined for example by the contact of the armature connected to the valve needle 5 against the core of the electromagnetic circuit. The path between these two end positions of the valve needle 5 consequently represents the stroke.

On its end 27, the retaining collar 26 of the injection port disk 21 is sealingly and securely connected to the wall of the longitudinal opening 3. For this purpose, a circumferential weld 30 is provided between the end 27 of the retaining collar 26 and the wall of the longitudinal opening 3. Outside the central region 24, the bottom part 20 is sealingly connected to the valve seat body 16 with another circumferential weld 31.

The ball-shaped valve closing body 7 cooperates with the valve seat face 29 of the valve seat body 16, which valve seat face tapers in the shape of a truncated cone in the flow direction and is embodied as an outflow opening 32 in the lower end face 17 of the valve seat body 16. For the exact guidance of the valve closing body 7 and therefore of the valve needle 5 during the axial movement, the diameter of the guide opening 15 is embodied so that the ball-shaped valve closing body 7 penetrates the guide opening 15 with a slight radial spacing outside its flat surfaces 8.

The injection ports 25 disposed in the central region 24 of the injection port disk 21 are overlapped by the outflow opening 32. A collection chamber 37 is formed between the valve closing body 7, the upper end face 19 of the bottom part 20, and the wall of the valve seat face 29, as well as the outflow opening 32; when the valve closing body 7 lifts off from the valve seat face 29, the fuel first flows into this collection chamber before it is apportioned by the injection ports 25 and injected into an air intake line of the internal combustion engine. A certain small quantity of fuel remains behind in this collection chamber 37 even after the closing of the fuel injection valve. The goal is therefore to embody this so-called clearance volume constituted by the collection chamber so that it is as small as possible, in order to keep the quantity of fuel contained in it after the closing of the fuel injection valve as small as possible. A disadvantage of the fuel contained in the collection chamber 37 after the closing of the fuel injection valve is comprised in that after the engine is switched off, the fuel at least partially evaporates as a result of the heating from the engine that occurs. As a rule, though, only an evaporation of the components of the fuel which evaporate at low temperatures occurs, while the components of the fuel which evaporate at higher temperatures remain behind and lead to deposits in the injection ports 25. Deposits in the injection ports 25, though, have the result that given a constant opening time of the fuel injection valve, a lower quantity of fuel is injected into the air intake line, by means of which the fuel/air mixture is leaned down and the performance of the engine changes in an unfavorable manner.

A gap disk 40 is disposed in the longitudinal opening 3 of the valve housing 1, downstream of the injection port disk 21, which gap disk has a central hole 41, which runs concentric to the longitudinal valve axis 2 and whose diameter is greater than the diameter of the outflow opening 32. The gap disk 40 is for example likewise embodied as cup-shaped and has a conical, outwardly extending gap disk retaining collar 42, which is directed extending away from the injection port disk 21. On its free end 43, the gap disk retaining collar 42 has a greater diameter than the longitudinal opening 3 so that the gap disk 40 is pressed into the longitudinal opening 3 and the free end 43 rests against the wall of the longitudinal opening 3 with a radial tension. Additionally, there is another possibility of the fastening of the gap disk 40 in the longitudinal opening 3 in that the free end 43 is fastened in the longitudinal opening 3 by means of a weld 44, which can be embodied as circumferential or as individual weld points. Between a gap disk bottom 45 of the gap disk 40 and the bottom part 20 of the injection port disk 21, an axial spacing parallel to the longitudinal valve axis 2 of approximately 0.5 to 1 mm is provided so that between the bottom part 20 and the gap disk bottom 45, a recess 47 is embodied which in the axial extension has a very small measure of only approximately 0.5 to 1 mm. If after the switching off of the engine, an evaporation of fuel in the collection chamber 37 and an overflow of fuel from the collection chamber 37 into the injection ports 25 now occurs, then the recess 47 acts upon the fuel present in the injection ports 25 like a capillary and draws this fuel away from the injection ports 25 radially toward the outside into the recess 47. This embodiment of the recess 47 as an annular capillary gap formed between the injection port disk 21 and the gap disk 40 represents a first exemplary embodiment of the invention.

Figure 2:
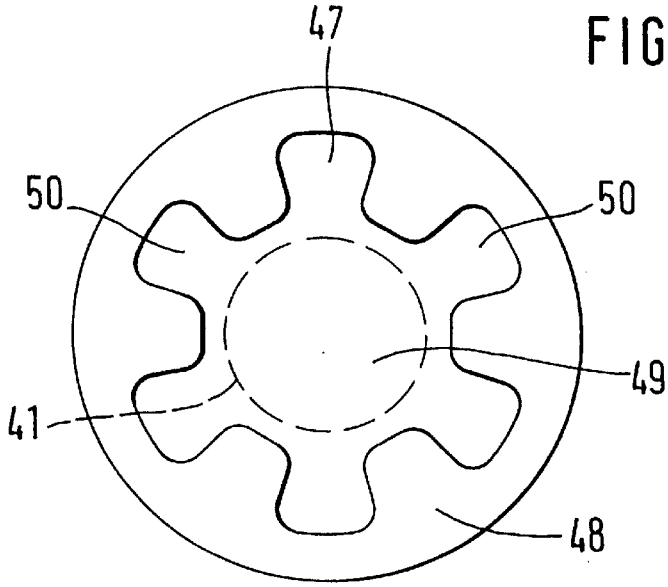
FIG. 2 shows a top view of a capillary disk.

A second exemplary embodiment of the invention is likewise shown in FIG. 1 and additionally in FIG. 2. With this second exemplary embodiment of the invention, a capillary disk 48 is inserted into the longitudinal opening 3 between the injection port disk 21 and the gap disk 40, which capillary disk rests with its upper end against the bottom part 20 of the injection port disk 21 and with its lower end against the gap disk bottom 45 of the gap disk 40. The capillary disk 48 is for example made of plastic or rubber. In FIG. 2, the capillary disk 48 is shown in a top view. In particular in FIG. 2, it can be seen that the capillary disk 48 is provided with a star-shaped opening 49 which has slots 50 which extend in a star shape in the radial direction. In the circumference direction, the slots 50 have for example an even spacing to one another and open toward the injection ports 25 and the central hole 41 of the gap disk 40. In their inner width, for example, the slots 50 are embodied lateral to the longitudinal valve axis 2 so that they narrow or widen toward the circumference of the capillary disk 48. The inner width of the slots 50 in the circumference direction is small in comparison to the diameter of the central hole 41 of the gap disk 40. The capillary volume between the injection port disk 21 and the gap disk 40, which is desired for the achievement of the capillary action, can easily be optimized by the disposition of the capillary disk 48.

The foregoing relates to a preferred exemplary embodiment of the invention, it being understood that other variants and embodiments thereof are possible within the spirit and scope of the invention, the latter being defined by the appended claims.

What is claimed and desired to be secured by Letters Patent of the United States is:

1. A fuel injection valve for internal combustion engines, comprising a valve housing, a valve seat body disposed in a longitudinal opening of the valve housing, an injection port disk disposed downstream of the valve seat body in the longitudinal opening, at least one injection port is provided in said disk, a gap disk (40) with a central hole (41) is disposed in the longitudinal opening (3) in the immediate vicinity of the at least one injection port (25) and at least one recess (47, 50) is provided between the injection port disk (21) and the gap disk (40), said at least one recess (47, 50) opens directly toward the central hole (41) and extends radially outward, fuel is injected from the at least one injection port (25) straight through the at least one recess (47, 50) and straight through the central hole (41), whereby said recess exerts a capillary action outward in a radial direction beyond the at least one injection port (25) upon the fuel emerging from the at least one injection port (25).

2. The fuel injection valve according to claim 1, in which said at least one recess is overlapped by the gap disk (40).

3. The fuel injection valve according to claim 1, in which the recess (47) is embodied as annular.

4. The fuel injection valve according to claim 1, in which the injection port disk (21) rests against a capillary disk (48) and this capillary disk rests against the gap disk (40), and the at least one recess (47, 50) opens toward the central hole (41) and is embodied in the capillary disk (48).

5. The fuel injection valve according to claim 4, in which the capillary disk (48) is comprised of plastic.

6. The fuel injection valve according to claim 4, in which the at least one recess (47, 50) is embodied as slot-shaped.

7. The fuel injection valve according to claim 6, in which the at least one recess (47, 50) changes in width with increasing radial extension in the circumference direction.

8. The fuel injection valve according to claim 6, in which an inner width of the at least one recess (47, 50) is small in a circumference direction in comparison to a diameter of the central hole (41) of the gap disk (40).

9. The fuel injection valve according to claim 4, in which the recess (47, 50) is embodied as star-shaped.

10. The fuel injection valve according to claim 1, in which the gap disk (40) is embodied as cup-shaped.

* * * * *